US007424345B2

(12) United States Patent
Norbeck

(10) Patent No.: US 7,424,345 B2
(45) **Date of Patent: *Sep. 9, 2008**

(54) AUTOMATED PART PROCUREMENT AND SERVICE DISPATCH

(75) Inventor: Dean K. Norbeck, Marco Island, FL (US)

(73) Assignee: York International Corporation, York, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/872,430

(22) Filed: Oct. 15, 2007

(65) Prior Publication Data

US 2008/0033600 A1 Feb. 7, 2008

Related U.S. Application Data

(63) Continuation of application No. 11/388,502, filed on Mar. 24, 2006, now Pat. No. 7,295,896.

(51) Int. Cl.
*G01M 1/38* (2006.01)

(52) U.S. Cl. ..... 700/276

(58) Field of Classification Search ..... 700/101, 700/107, 175, 177, 214, 276
See application file for complete search history.

(56) References Cited

U.S. PATENT DOCUMENTS 6,343,251 B1 * 1/2002 Herron et al. ..... 701/100
6,389,337 B1 * 5/2002 Kolls ..... 701/29
6,728,619 B2 * 4/2004 Sugiyama et al.
6,813,532 B2 * 11/2004 Eryurek et al. ..... 700/108
2002/0072986 A1 * 6/2002 Aram ..... 705/26
2002/0082884 A1 * 6/2002 Moroney et al. ..... 705/7
2002/0087419 A1 * 7/2002 Andersson et al. ..... 705/26
2002/0123864 A1 * 9/2002 Eryuerk et al. ..... 702/188
2002/0128790 A1 * 9/2002 Woodmansee ..... 702/81
2002/0169514 A1 * 11/2002 Eryurek et al. ..... 700/110
2003/0014149 A1 * 1/2003 Kreidler et al. ..... 700/169
2003/0195640 A1 * 10/2003 Krocker et al. ..... 700/26
2004/0044598 A1 * 3/2004 Hosaka ..... 705/28
2004/0073468 A1 * 4/2004 Vyas et al. ..... 705/8
2004/0122689 A1 * 6/2004 Dailey et al. ..... 705/1
2004/0204977 A1 * 10/2004 Obert ..... 705/8
2005/0119794 A1 * 6/2005 Amundson et al. ..... 700/276
2005/0125102 A1 * 6/2005 Nichols et al. ..... 700/276

* cited by examiner

*Primary Examiner*—Albert DeCady
*Assistant Examiner*—Chad Rapp
(74) *Attorney, Agent, or Firm*—McNees Wallace & Nurick, LLC

(57) ABSTRACT

A method for repairing an HVAC system is disclosed. The method includes monitoring a plurality of sensors positioned throughout the HVAC system and receiving data associated therewith, determining whether the data received from the plurality of sensors is within corresponding predetermined operational parameters, analyzing data determined to be outside the corresponding predetermined operational parameters to diagnose a malfunction of the HVAC system, accessing an on-board bill of materials to determine a proper replacement part to correct the malfunction, automatically ordering the replacement part, and automatically dispatching a service technician to install the replacement part.

10 Claims, 2 Drawing Sheets

AUTOMATED PART PROCUREMENT AND SERVICE DISPATCH

CROSS-REFERENCE TO RELATED APPLICATIONS

This application is a continuation of U.S. application Ser. No. 11/388,502, filed Mar. 24, 2006, now U.S. Pat. No. 7,295,896 allowed issued Nov. 13, 2007, which is incorporated by reference in its entirety.

FIELD OF THE INVENTION

The present invention is directed to self-diagnosis of malfunctioning equipment and more particularly directed to automatically procuring replacement parts for use in the repair of malfunctioning equipment and the coordinated dispatching of a service technician to perform the repair.

BACKGROUND OF THE INVENTION

Commercial heating, ventilation and air conditioning (HVAC) units, such as aptly named "rooftop units," are often assembled onto the flat roofs of structures such as supermarkets, office buildings and other commercial structures.

Chillers, or chilled water units, are cost-effective systems that utilize both water or other suitable liquids and refrigerants. Chillers cool the water or other liquid, then circulate the cooled water to other components in the system, such as an air handling unit. Chillers are typically located in equipment rooms such as in basements or at other remote locations of large buildings. Water is an excellent secondary coolant because it is readily available, inexpensive, non-toxic and substantially non-corrosive. It also has a favorable specific heat value. Other secondary coolants can also be used, depending upon the application. These include calcium chloride or sodium chloride brines, methanol, propylene glycols, ethylene glycol and glycerin. Chillers are frequently used for commercial air conditioning and industrial process cooling as well as for low temperature refrigeration. While there are various types of chillers, which may include many different components, a chiller typically includes a compressor, a motor and a control center, which may be in the form of a microprocessor control. A chiller can also include, in addition to the above equipment, a condenser, an evaporator and a metering device.

Due to their sometimes difficult-to-reach locations, servicing chillers and rooftop units can be time consuming and inefficient, particularly if a service technician must make multiple trips to diagnose and later return with proper parts to effect a repair. However, most current methods of monitoring the operation of chillers, rooftop units of air conditioning systems, or other HVAC systems do not provide the capability to diagnose an existing problem or anticipate the occurrence of a problem that could result in shut down or improper operation of equipment and to arrange for that problem to be repaired.

What is needed is a system for monitoring an HVAC system that utilizes information from the control center of the unit to automatically identify a malfunctioning part causing a problem, place an order for that part, and dispatch a service technician to install the replacement part upon its arrival.

SUMMARY OF THE INVENTION

The present invention is a method and system for monitoring operations of a heating ventilating and air conditioning (HVAC) system such as a chiller system or a rooftop unit having a control center, and upon occurrence of a malfunction or other system failure, to automatically order needed replacement parts and dispatch a service technician to install the parts and make the repair. The system utilizes a control center located on-site, that is to say, at the facilities at which the chiller system or rooftop unit is located. The control center is in one-way communication with sensors configured to monitor components of the chiller system and receives data indicative of the operation of each of the components. The control center determines whether each component is operating within the normal operating parameters and stores data indicative of component operation in memory. If the data indicates that the HVAC system component is operating outside of normal parameters, a processing unit in the control center evaluates the information and determines whether remedial action is required. If a malfunction has occurred and remedial action is required, the control center determines the remedial action needed to correct the malfunction, including accessing a bill of materials to determine a proper replacement part. The processing unit then initiates a communication to order the replacement part from a repair center and dispatches a service technician to perform the repair.

A method for repairing an HVAC system is disclosed. The method comprises the steps of monitoring a plurality of sensors positioned throughout the HVAC system and receiving data associated therewith, determining whether the data received from the plurality of sensors is within corresponding predetermined operational parameters, conducting a diagnosis of the HVAC system to identify a malfunction of the HVAC system in response to having data determined to be outside the corresponding predetermined operational parameters, accessing an on-board bill of materials to determine a proper replacement part to correct the malfunction, automatically ordering the replacement part, and automatically dispatching a service technician to install the replacement part.

A system for automatically procuring parts and dispatching a service technician to repair an HVAC system is also disclosed. The system comprises a plurality of sensors positioned throughout the HVAC system and an HVAC system control center in communication with the plurality of sensors, the control center comprising a microprocessor, a memory and a communications port. The microprocessor comprises computer instructions to execute the steps of monitoring data received from the plurality of sensors, comparing the received data against pre-determined operational parameters, analyzing data outside of the operational parameters to determine an HVAC system malfunction, accessing an on-board bill of materials from the memory to identify a replacement part based on the data analysis to correct the HVAC system malfunction, initiating a call to a parts center via the communications port to order the replacement part, and initiating a call via the communications port to dispatch a service technician to install the replacement part.

One advantage of exemplary embodiments of the present invention is that the HVAC system can perform a self-diagnosis and in response to that diagnosis, automatically order a replacement part without the need for a service technician to make a diagnostic visit and a subsequent repair visit to install the part in the malfunctioning system.

Another advantage of exemplary embodiments of the present invention is the ability to reference an on-board bill of materials stored in memory to automatically determine a proper replacement part in light of a self-diagnosis by the HVAC system.

Still another advantage of exemplary embodiments of the present invention is direct communication by the HVAC system to order replacement parts and dispatch a service technician without the need to route communications through a central HVAC service center or other intermediary.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Where the same parts are referred to in different Figures, like numerals are used for ease of identification.

DETAILED DESCRIPTION OF EXEMPLARY EMBODIMENTS OF THE INVENTION

Figure 1:
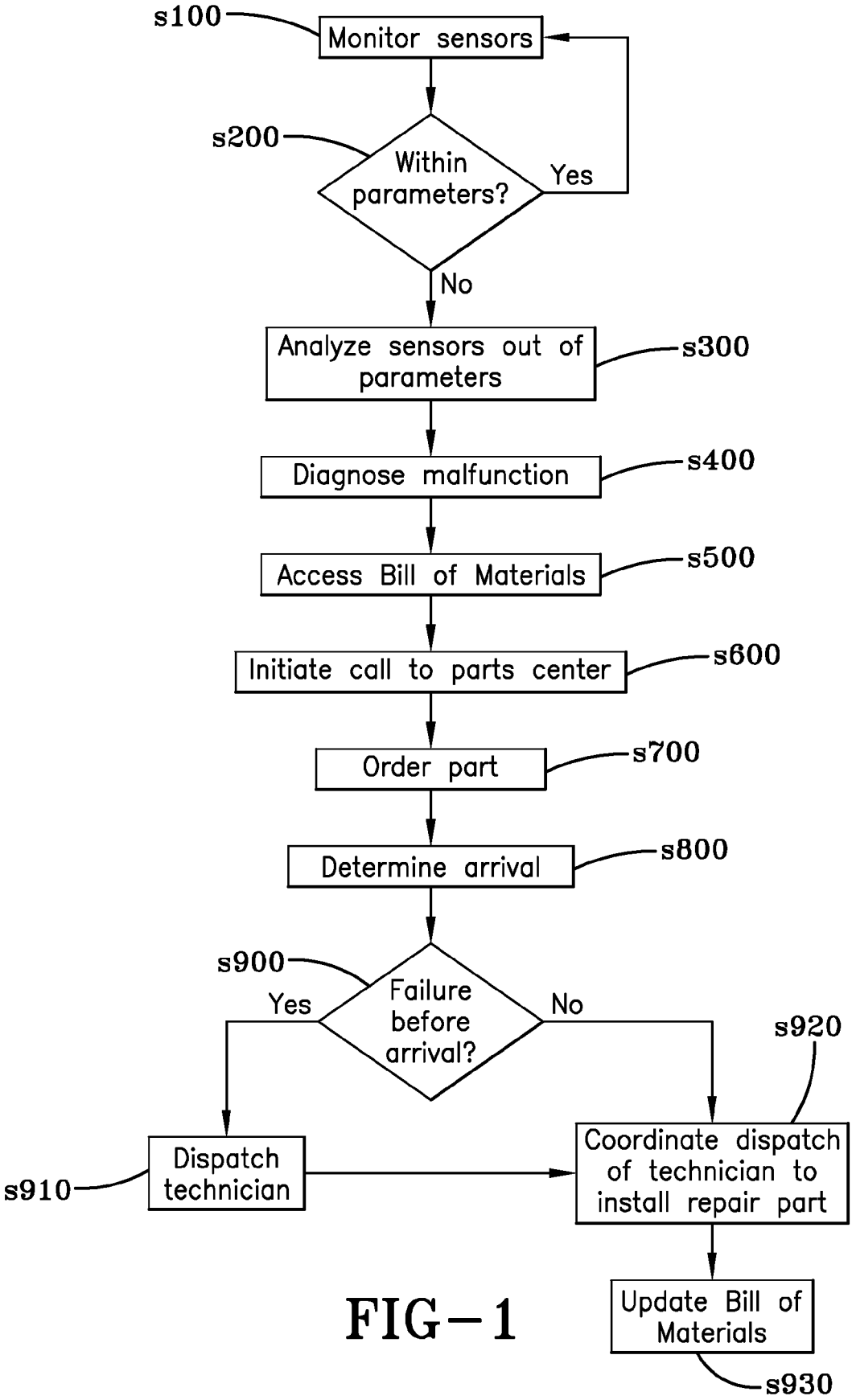
FIG. 1 is a flowchart illustrating a method of repairing an HVAC system using automated part procurement and service dispatch according to an exemplary embodiment of the invention.

Exemplary embodiments of the invention are directed to automated part procurement and service dispatching for an HVAC system that includes a control center to automatically analyze a system malfunction and determine appropriate repairs for the HVAC system. Based on the determined needed repair, a processor accesses an on-board bill of materials, i.e. stored in a memory local to the HVAC system, to identify a replacement part(s) needed for the repair. The processor then initiates a communication with a repair center and orders the part(s). Additionally, a service technician is automatically dispatched to repair the HVAC system.

Control centers with diagnostic capabilities are well known for use in HVAC systems to diagnose and record HVAC system faults and failures for later access by a service technician called to the site of HVAC system. The control center's diagnostic capabilities typically involve receiving electronic communications from various types of sensors positioned throughout the HVAC system that sense operating parameters of the HVAC system. The HVAC system operating parameter data is communicated to a microprocessor that monitors parameters of the HVAC system during operation.

According to exemplary embodiments of the invention, the microprocessor has the ability to receive and analyze the operating parameter data, as well as the ability to initiate external communication protocols. When the HVAC system fails or malfunctions, the monitored parameters can be used to determine the cause of error though artificial intelligence or a series of logic rules relating to failure symptoms stored in memory to identify a failed part. The parameters can also be used to identify a part that is near failure and which needs to be replaced before the system breaks down. The microprocessor accesses the bill of materials to determine indicia associated with the failed part, such as a part number, useful for ordering a replacement part. The microprocessor initiates a communication with a parts center and electronically places an order for the proper part. Another communication notifies a service technician of the failure. The notification may be delivered in any convenient manner. Preferably, the notification is either electronic, such as an email sent to a predetermined email address, or telephonic, using speech generation software. Based at least in part on the communication with the parts center or other source of the replacement part, the microprocessor coordinates and dispatches the technician to the repair site when the replacement part is due to arrive or soon after it is due to have arrived. In some emergency situations, the microprocessor may dispatch a service technician before the part is due to arrive, for example, if the microprocessor determines the replacement part is not expected to arrive prior to system failure.

Preferably, all of the communications originate from the HVAC system and connect directly to the parts center, service office and/or service technician without the need to be routed through a central HVAC service hub or other intermediary. The microprocessor may initiate yet another communication to a point of contact, such as the owner or maintenance department of the building associated with the malfunctioning HVAC system and advise the owner of the scheduled repair. The communication may provide the owner an opportunity to decline or postpone the repair, upon the occurrence of which the part order and/or dispatch call may be cancelled. In most cases, however, maintaining uninterrupted, or minimally interrupted HVAC service is desired or even necessary and the replacement part and service technician automatically arrive at the customer site prior to any loss of service to the customer or in some cases even before the customer notices a problem.

A bill of materials, which may be limited to a bill of replaceable materials, for the HVAC system is incorporated into the memory of the control center, giving the microprocessor access to information identifying the components in the HVAC system, such as condensers, evaporators, burners or compressors, as well as sub-components of those components, such as valves, motors, transducers, sensors, or filters, all by way of example only. Information pertaining to site location is also incorporated into the control center memory. Delivery information, if different from site location, and contact information is also preferably included in the memory.

The bill of replaceable materials could also be visually displayed to a screen or other output device as a look-up table available to the technician once on-site. The technician can then verify the correct part number was ordered or the technician may order any additional parts determined to be needed. When a part is replaced, the bill of materials may be manually or automatically updated to reflect the current on-board components.

Figure 2:
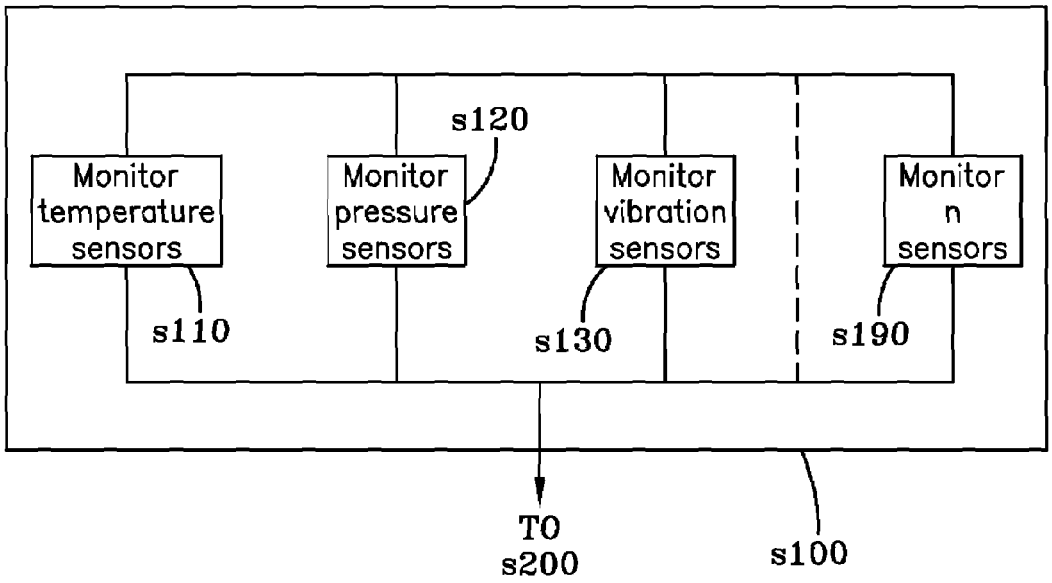
FIG. 2 is a portion of the flowchart of FIG. 1 further illustrating the step of monitoring with sensors.

The invention is further described with respect to the following non-limiting example illustrated in FIG. 1. At s100, one or more sensors is monitored by a microprocessor associated with a control center of an HVAC system, or in some cases, with a control center of a particular HVAC component, in which the microprocessor is in one-way communication with the sensors. Different sensors may be used to measure any of a number of different types of properties useful for diagnosis of HVAC system function (or malfunction) or other properties desired to be monitored. As shown in FIG. 2, temperature sensors, pressure sensors and vibration sensors are each monitored at s110, s120 and s130. Additional sensors may also be measured as illustrated with the generic step s190. Typically, monitoring the sensors includes at least monitoring pressure, temperature, and vibration sensors. Voltage and current are also typically monitored properties using appropriate sensors. For each property to be measured, one or more sensors may be used. Each sensor is placed at a pre-determined location in the HVAC system selected for the best monitoring of the property of the HVAC system.

Returning to FIG. 1, a determination is made whether data received from the sensors being monitored are within predetermined operating parameters associated with normal operating functionality at s200. If all of the sensors are within the parameters, the process returns to s100 for further monitoring. If data from one or more of the sensors is not within the parameters, the process passes to s300 and the measured properties are analyzed. Using information based at least in part on the number and type of sensors that received data falling outside the parameters and the magnitude by which the measured properties are non-compliant, the microprocessor determines the source of the malfunction with reference to diagnostic information stored in a control center memory accessible to the microprocessor in order to diagnose the malfunction at s400. For example, in a chiller, the sensors may determine that vibration sensors located near the chiller motor are reporting vibrations that fall outside of normal operating parameters. Using this information, and with reference to corresponding diagnostic information stored in the memory, the microprocessor may determine that the location and magnitude of the sensed vibration is consistent with motor bearings that are starting to fail in the chiller motor.

It will be appreciated that in many cases, changes in properties monitored throughout the HVAC system will be the result of changes due to normal system operation, such as a change in load that results in changes in temperature or pressure, and are not attributable to changes in temperature or pressure that signal a malfunction. Thus, the diagnostic information typically includes a range of compliant behavior using known trends and pre-determined allowable limits expected to occur in normal operation. In some cases, the operating parameters themselves may associated with pre-determined load conditions, such that the acceptable operating parameters against which the monitored data is compared changes as the load changes.

The diagnostic information is typically analyzed over a pre-determined period of time. Analyzing non-compliant parameters with respect to time may be particularly useful in differentiating a slight change or aberration in normal system operating conditions from a malfunction or impending system failure.

In some cases, where the measured parameters are to be evaluated over time, the microprocessor may also compile and record a log of changes in the memory for use in later analysis in identifying a slowly failing part or to form a base line against which later conditions can be compared. This type of trend analysis may further depend on the magnitude by which the monitored parameters exceed the normal operating parameters. Returning to the chiller motor example, vibrations may begin as minor fluctuations outside of the operating parameters but persist over the course of several days or increase in frequency or magnitude. The vibrations may initially only exceed operating parameters by less than 1%, but increase over the course of a week to be 10% or more outside of the operating parameters. Based on the percentage by which the vibrations exceed parameters over a period of time, a trend can be determined to identify the malfunction and/or project how long the part will operated with the malfunction before failure. By analyzing properties over time to determine a trend, the microprocessor may avoid ordering parts that were aberrations in operation and not true malfunctions requiring a repair. By way of further example, the monitored vibration data may exceed the operating parameters by a small percentage and then return to normal for at least a pre-determined period of time without again exceeding the operating parameters.

Conversely, if the chiller motor vibrations quickly escalate well outside of the normal operating parameters, the microprocessor may earlier or immediately identify the malfunction and a needed repair. The diagnostic parameters preferably include safety limits, wherein parameters measured outside of the safety limits indicate the malfunction creates a safety hazard or indicates an imminent catastrophic system failure and results in an emergency shutdown.

Whether or not trend analysis is used as part of the part failure analysis, a separate log of malfunctions determined, as well as the parameters causing each diagnosis, may be compiled and stored in the control center memory. The log may be reviewed by a service technician once on-site. Alternatively, the technician may review the log in advance of arriving at the site by remotely accessing the control center over a communication network, such as the internet.

At s500, the microprocessor accesses a bill of materials also stored in the control center memory. It should be appreciated that the bill of materials may be accessed either before or after the HVAC malfunction has been diagnosed. In some circumstances, identifying whether a specific part is a component of the HVAC system may be helpful or necessary to properly analyze and diagnose the malfunction. In combination with the diagnosed error, the bill of materials can be used by the microprocessor to identify the part or parts that need to be replaced in order for the HVAC system to be repaired. In the example of motor bearing failure in the chiller motor, the microprocessor may determine that the chiller has a particular type of chiller motor, and that a particular model number is needed to effect the repair. In some circumstances, the bill of materials may also contain certain other key characteristics of the on-board part useful in ordering a suitable replacement part, for example, in the event the particular model number is no longer available. By way of further example, the bill of materials may contain information regarding the size and capacity of the chiller motor in addition to, or in lieu of, a specific part number.

Once the part(s) to be replaced is identified, a request to one or more pre-selected parts centers is initiated at s600 by the microprocessor using a communications port associated with the control center. The communications port may be adapted for either or both of wired and wireless communications and may be telephonic or electronic. Preferably, contact information for multiple pre-selected parts centers is accessible by the microprocessor in the event that the first contacted parts center is unable to deliver the necessary replacement part as discussed below. In addition to the part itself, information for payment and delivery may also be communicated by the microprocessor. The payment and delivery information may be separately stored in memory, but preferably is associated with the bill of materials.

The microprocessor is adapted for two-way external communications in order to receive information from the parts center. In this manner, the microprocessor may first order the part at s700 and then receive information sufficient to determine an expected arrival of the replacement part at s800. If the arrival date is beyond a pre-selected period of time, the microprocessor may initiate a call to one of the other pre-selected parts centers in an attempt to more quickly procure the necessary part. If successful in identifying an earlier arrival date, the control center places an order with the parts center providing the earlier-to-arrive part, and if necessary, cancels any less-timely order previously placed with a different parts center. The pre-selected acceptable period of time for delivery may be any desired period of time and may be determined at least in part by the urgency of the repair as calculated during the diagnostics. The pre-selected period of time may also be determined based on a particular customer's status, such as depending on the size, importance or nature of business of the customer.

After, the part has been ordered, the microprocessor also initiates a communication to dispatch a service technician to install the replacement part and who may conduct any further on-site analysis that the technician determines is appropriate. The service dispatch may be made directly to a specific technician assigned to the particular HVAC site or may be routed through a service office to dispatch any available technician.

As shown in FIG. 1, preferably the microprocessor first determines whether the malfunction that initiated the automatic part procurement process is likely to result in a system failure and/or shutdown prior to the part's arrival at s900. If so, it may be desirable to dispatch a technician in advance of the part's arrival to perform stop-gap maintenance at s910 until the proper part arrives. Preferably, the parameters used to determine whether the HVAC system is operating normally are selected in combination with sensors sensitive enough to diagnose a malfunction well in advance of failure. In this way, the automatic part procurement can be initiated far enough in advance such that the microprocessor dispatches the service technician at s920 in a manner coordinated with the expected arrival of the replacement part. Returning to the example of a chiller with failing motor bearings, the microprocessor may determine that based on the level of vibration detected, the motor is likely to operate for at least another 200 hours to failure. Thus, if the appropriate replacement part procured through the parts center was designated for arrival in four days, a service technician could be automatically dispatched to install the new motor on day five without significant risk of system failure in the interim. It will be appreciated, that in addition to the day, an expected time of delivery may also be provided, such that the expected arrival date includes both the day and time of expected arrival.

After the replacement part has been installed, particularly where the replacement part is not the same model number as the part replaced, the bill of materials may be automatically or manually updated by the service technician so that the bill of materials accurately reflects the post-repair make-up of the HVAC system.

While the foregoing example was described with respect to motor bearings of a chiller, it will be appreciated that any number of components within a chiller or other HVAC system can be monitored and analyzed using a variety of diagnostic sensors, and that the systems and methods described can be used with these other HVAC systems and their respective components.

Figure 3:
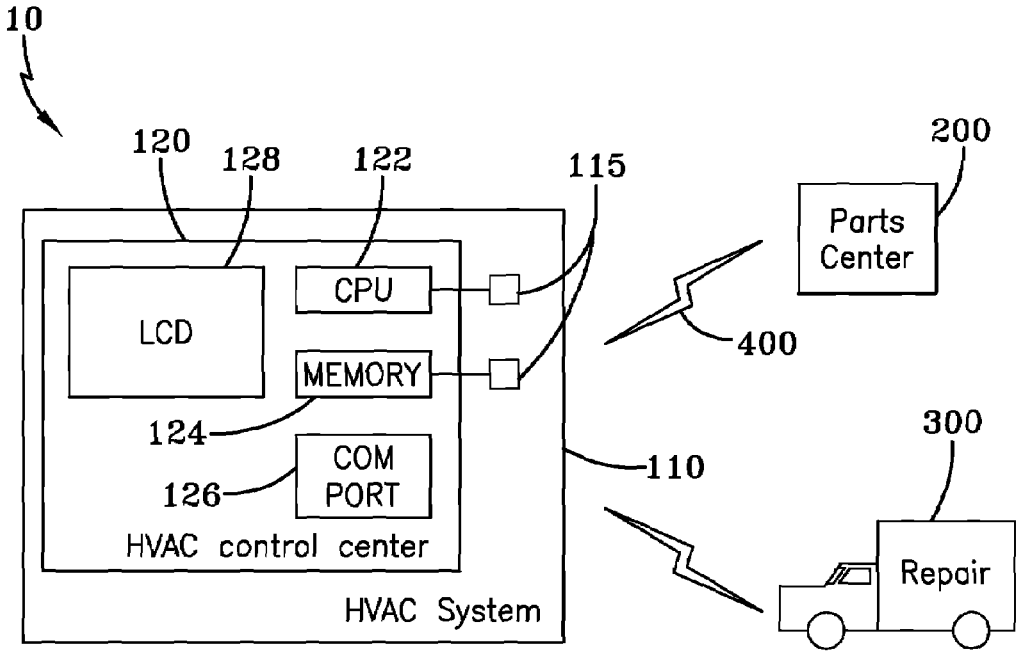
FIG. 3 is a system for automated part procurement and service dispatch according to an exemplary embodiment of the invention.

FIG. 3 illustrates an exemplary system 10 for automated part procurement and service dispatching according to an embodiment of the invention. An HVAC system 110 having an HVAC control center 120 is located at an installation site. HVAC systems which may particularly benefit from the present invention include chillers and other large commercial HVAC systems that are often placed in difficult to service locations, such as on building rooftops, and thus particularly benefit from the efficiency of limiting the number of on-site visits for system repair. As illustrated, the HVAC control center 120 comprises a microprocessor 122, which may be a CPU or any other suitable processor, a memory 124, a communications port 126, and a display screen 128. The display screen 128 is typically, but need not necessarily be, a liquid crystal display (LCD). The display screen 128 typically provides for visual monitoring of the HVAC system 110 operations by the technician once on-site. Preferably, the display screen 128 also permits viewing the bill of materials and a log of recorded faults, including the faults that led to the ordering of the replacement part and the dispatch of the service technician viewing the display screen 128. The memory 124 can be any form of electronic storage device suitable for storing data accessible by the microprocessor 122, including by way of example only, a hard disk, flash memory, CD-ROM, DVD-ROM, or computer memory (RAM or ROM).

A plurality of sensors 115 are distributed at pre-determined locations throughout the HVAC system 110, which plurality of sensors 115 are in one-way communication with the control center 120 such that the microprocessor 122 monitors and analyzes data sent by the sensors 115. The microprocessor 122 is in two-way communication with a parts center 200 to order replacement parts as described above via the communications port 126 over a communications network 400, which may be either or both of a wired or wireless communications network. The microprocessor is also in communication with a service office 300 or directly with a service technician via the communications port 126 over the communications network 400 to coordinate the dispatch of the service technician with the arrival of the ordered replacement part as also described above.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A method for repairing an HVAC system comprising the steps of:

monitoring a plurality of sensors positioned throughout the HVAC system;

receiving data associated with the sensors outside of predetermined operational parameters;

identifying a malfunction of the HVAC system corresponding to the received data outside of the corresponding predetermined operational parameters;

accessing an on-board bill of replaceable HVAC system materials to determine a proper replacement part to correct the malfunction;

automatically ordering the replacement part; and automatically dispatching a service technician to repair the HVAC system.

2. The method of claim 1, wherein the step of automatically ordering the replacement part comprises initiating a communication to a parts center via a communications port, and ordering the replacement part from the parts center for delivery to the HVAC system.

3. The method of claim 1, further comprising determining an arrival date of the ordered replacement part at the location of the HVAC system from a first parts center; and determining whether an HVAC system failure will occur prior to the determined arrival date.

4. The method of claim 3, further comprising dispatching a service technician to the HVAC system before the determined arrival date in response to determining the HVAC system failure will occur prior to the determined arrival date.

5. The method of claim 3, further comprising canceling an automatically ordered replacement part from a first parts center and automatically ordering a replacement part from a second parts center in response to determining the arrival date from the first parts center.

6. The method of claim 1, wherein the monitoring a plurality of sensors comprises monitoring sensors selected from the group of temperature sensors, pressure sensors, vibration sensors, current sensors, voltages sensors, and combinations thereof.

7. The method of claim 1, wherein the step of automatically ordering the replacement part comprises electronically ordering the replacement part from a parts center.

8. The method of claim 1 further comprising the step of automatically advising a point of contact associated with the HVAC system of the HVAC system malfunction.

9. The method of claim 1 further comprising recording a log of the data determined to be outside the corresponding predetermined operational parameters; and remotely accessing, by a service technician, the log of the data determined to be outside the corresponding predetermined operational parameters.

10. The method of claim 1 further comprising updating the on-board bill of materials to include the replacement part.

* * * * *